US012649098B2

(12) United States Patent
Yamamoto

(10) Patent No.: US 12,649,098 B2
(45) Date of Patent: Jun. 9, 2026

(54) INFORMATION PROCESSING METHOD, INFORMATION PROCESSING DEVICE, RECORDING MEDIUM, AND INFORMATION PROCESSING SYSTEM

(71) Applicant: CASIO COMPUTER CO., LTD., Tokyo (JP)

(72) Inventor: Futoshi Yamamoto, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 18/899,535

(22) Filed: Sep. 27, 2024

(65) Prior Publication Data

US 2025/0114686 A1 Apr. 10, 2025

(30) Foreign Application Priority Data

Oct. 4, 2023 (JP) ..... 2023-172480

(51) Int. Cl.
*A63B 71/06* (2006.01)
*A63B 69/00* (2006.01)

(52) U.S. Cl.
CPC ..... *A63B 71/0622* (2013.01); *A63B 69/0028* (2013.01); *A63B 2071/063* (2013.01); *A63B 2220/803* (2013.01)

(58) Field of Classification Search
CPC ..... A63B 71/0622; A63B 2071/063
See application file for complete search history.

(56) References Cited

U.S. PATENT DOCUMENTS

| | | | | |
|---|---|---|---|---|
| 10,039,970 | B2 | 8/2018 | Lee et al. | |
| 10,518,163 | B2 | 12/2019 | Lee et al. | |
| 2010/0125024 | A1* | 5/2010 | Nakano | A63B 22/16 482/4 |
| 2020/0108305 | A1 | 4/2020 | Lee et al. | |

FOREIGN PATENT DOCUMENTS

| | | | |
|---|---|---|---|
| JP | 2015120085 | A | 7/2015 |
| JP | 2017042620 | A | 3/2017 |
| JP | 2017131327 | A | 8/2017 |

* cited by examiner

*Primary Examiner* — Robert J Utama
(74) *Attorney, Agent, or Firm* — Holtz, Holtz & Volek PC

(57) ABSTRACT

Disclosed is an information processing method executed by an information processing device including a memory in which a program is stored and at least one processor that executes the program, the method including specifying, by the processor, a characteristic of a voice that induces a change in a state value based on correspondence information in which the change in the state value before and after each transmission timing of multiple voices transmitted to a target person in action is associated with a characteristic of each of the multiple voices, the state value representing an action state of the target person.

14 Claims, 6 Drawing Sheets

132

| TARGET MOTION INDEX | STRIDE |
|---|---|
| LARGER-THE-BETTER/SMALLER-THE-BETTER/NOMINAL-THE-BEST | LARGER-THE-BETTER |
| SITE DIRECTLY RELATED TO MOTION INDEX | LEGS |

133

Ib

| EXERCISER ID | TIME | POSITION | RUNNING DISTANCE (km) | VELOCITY (km/h) | HEART RATE (bpm) | MOTION INDEX | | | |
|---|---|---|---|---|---|---|---|---|---|
| | | | | | | STRIDE (m) | VERTICAL MOVEMENT (cm) | GROUND CONTACT TIME (ms) | ··· |
| A001 | t1 | (N1,E1) | 0.25 | 9.4 | 120 | 1.11 | 7.8 | 240 | ··· |
| A001 | t2 | (N2,E2) | 0.50 | 10.5 | 125 | 1.08 | 7.6 | 234 | ··· |
| A001 | t3 | (N3,E3) | 0.75 | 10.6 | 132 | 1.07 | 7.7 | 231 | ··· |
| : | : | : | : | : | : | : | : | : | : |

FIG. 8

134

Ic

| VOICE ID | TARGET EXERCISER ID | TIME | CHARACTERISTIC ITEM OF VOICE | | | | | | STRIDE CHANGE RATE (%) |
|---|---|---|---|---|---|---|---|---|---|
| | | | VOLUME (−2～+2) (a) | INTENSITY OF EMOTION (−2～+2) (b) | RANGE OF CHANGE IN INTONATION (−2～+2) (c) | SEMANTIC CONTENT | | | |
| | | | | | | INSTRUCTION METHOD: DIRECT(+2) /INDIRECT(−2) (d) | POSITIVE(+2) /NEGATIVE(−2) (e) | MESSAGE | |
| M001 | A001 | T1 | −1 | 0 | −1 | +2 | +2 | RAISE YOUR LEGS HIGHER | −3 |
| M002 | A001 | T2 | +2 | +1 | −1 | −2 | +2 | SWING YOUR ARMS WIDELY! | +10 |
| M003 | A001 | T3 | +1 | −1 | +1 | −2 | −2 | YOUR BACK ISN'T STRAIGHT | +4 |
| M004 | A001 | T4 | 0 | +2 | +1 | +2 | +2 | HOLD OFF ON PUTTING YOUR LEGS ON! | −2 |
| : | : | : | : | : | : | : | : | : | : |

INFORMATION PROCESSING METHOD, INFORMATION PROCESSING DEVICE, RECORDING MEDIUM, AND INFORMATION PROCESSING SYSTEM

REFERENCE TO RELATED APPLICATIONS

This application is based upon and claims the benefit of priority from the prior Japanese Patent Application No. 2023-172480, filed on Oct. 4, 2023, the entire contents of which are incorporated herein by reference.

TECHNICAL FIELD

The present disclosure relates to an information processing method, an information processing device, a recording medium, and an information processing system.

DESCRIPTION OF RELATED ART

Conventionally, there is a technology that supports action of a target person by outputting various voices from a terminal device during the action of the target person wearing the terminal device. For example, JP-A-2017-42620 discloses a technology for supporting the target person's exercise by outputting voices of instruction, encouragement, and the like from a terminal device to the target person during exercise.

SUMMARY OF THE INVENTION

In order to solve the above problems, there is provided an information processing method executed by an information processing device including a memory in which a program is stored and at least one processor that executes the program, the method including specifying, by the processor, a characteristic of a voice that induces a change in a state value based on correspondence information in which the change in the state value before and after each transmission timing of multiple voices transmitted to a target person in action is associated with a characteristic of each of the multiple voices, the state value representing an action state of the target person.

BRIEF DESCRIPTION OF DRAWINGS

The accompanying drawings are not intended as a definition of the limits of the invention but illustrate embodiments of the invention, and together with the general description given above and the detailed description of the embodiments given below, serve to explain the principles of the invention, wherein:

FIG. 8 is a diagram showing the contents of voice transmission result data;

DETAILED DESCRIPTION

Below, the embodiment of the present disclosure is explained based on drawings.

(Configuration of Information Processing System)

Figure 1:
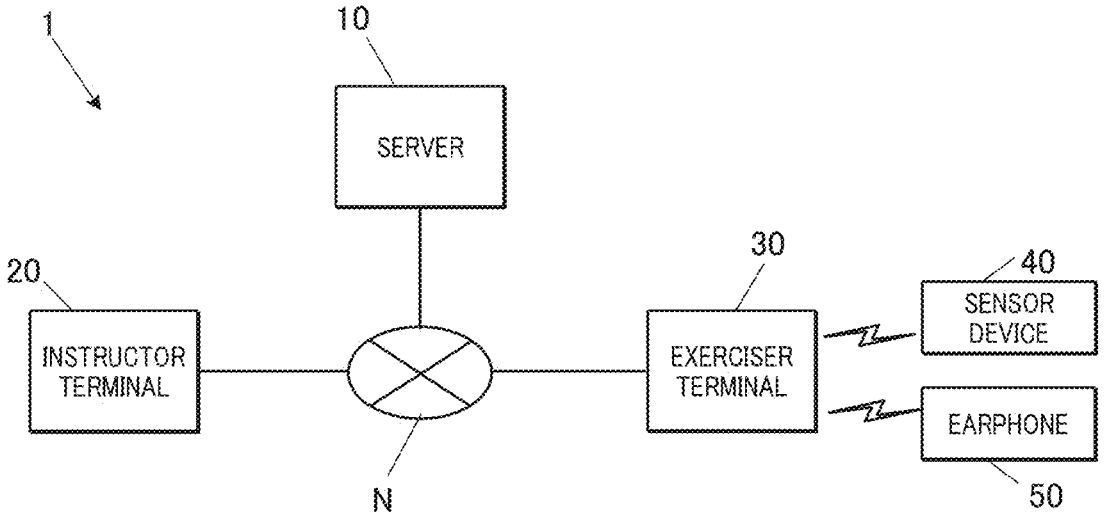
FIG. 1 is a diagram showing the configuration of an information processing system.

FIG. 1 is a diagram showing the configuration of an information processing system 1.

The information processing system 1 includes a server 10 (information processing device), an instructor terminal 20 (first terminal device), an exerciser terminal 30 (second terminal device), a sensor device 40 (motion sensor), and an earphone 50 (output section). The instructor terminal 20 and the exerciser terminal 30 are connected to the server 10 for data communication via a network N. The network N is, for example, the Internet, but is not limited to this. Each exerciser terminal 30 is connected to the sensor device 40 and the earphone 50 to enable data communication by short-range wireless communication such as Bluetooth (registered trademark).

The user of the information processing system 1 is, for example, an exerciser (target person) who performs an exercise (action), and an instructor (speaker) who provides voice instruction to the exerciser. The exercise performed by the exerciser may be training such as running, or a competitive event such as a marathon event. Also, it does not necessarily have to be an exercise involving movement from one place to another, and may be strength training, and the like. The instructor may be a motion analysis advisor, a friend, and the like. The exerciser uses the exerciser terminal 30, the sensor device 40, and the earphone 50. The instructor uses the instructor terminal 20. When multiple exercisers use the information processing system 1, the information processing system 1 may include multiple exerciser terminals 30, multiple sensor devices 40, and multiple earphones 50 corresponding to the multiple exercisers. Also, when multiple instructors use the information processing system 1, the information processing system 1 may include multiple instructor terminals 20 corresponding to the multiple instructors.

Figure 2:
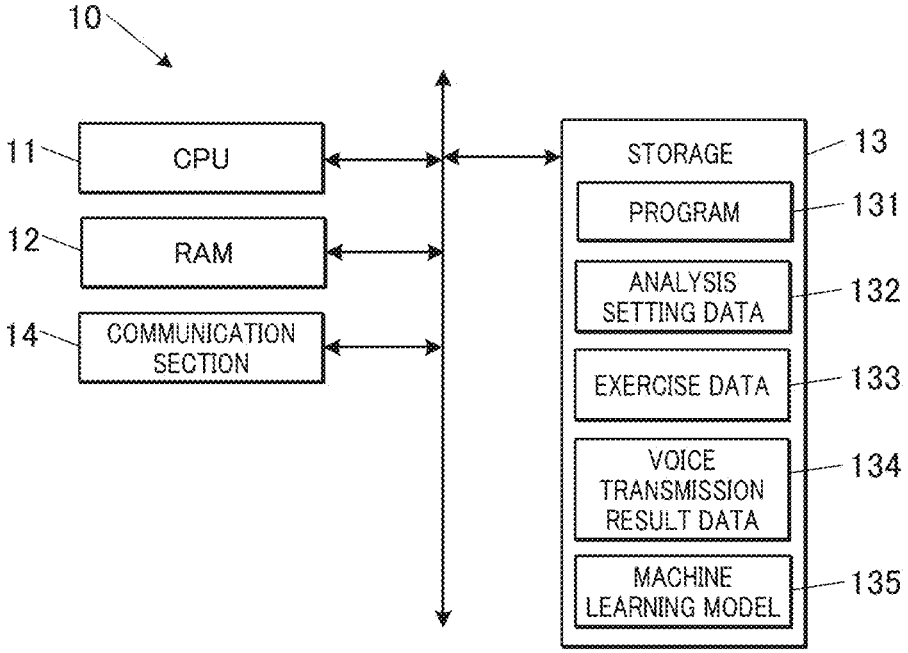
FIG. 2 is a block diagram showing the functional configuration of a server.

FIG. 2 is a block diagram showing the functional configuration of the server 10.

The server 10 includes a CPU 11 (central processing unit) (processing unit, at least one processor), a RAM 12 (random access memory), a storage 13, a communication section 14, and the like. Each part of the server 10 is connected via a communication path such as a bus.

The CPU 11 is a processor that controls the operation of each part of the server 10 by reading and executing a program 131 stored in the storage 13 and performing various arithmetic processing. The server 10 may have multiple processors (for example, multiple CPUs), and the multiple processors may execute multiple processes executed by the CPU 11 of the present embodiment. In this case, multiple processors correspond to "at least one processor". In this case, multiple processors may participate in a common process, or multiple processors may independently execute different processes in parallel.

The RAM 12 provides a memory space for work to the CPU 11 and stores temporary data.

The storage 13 is a non-temporary recording medium that can be read by a CPU 11 as a computer and stores the program 131 and various data. The storage 13 includes, for example, a non-volatile memory such as an HDD (Hard Disk Drive), an SSD (Solid State Drive), and the like. The program 131 is stored in the storage 13 in the form of a program code that can be read by a computer. The storage 13 stores analysis setting data 132, exercise data 133, voice transmission result data 134 (correspondence information), a machine learning model 135, and the like. Details on these data and the like will be described later.

The communication section 14 performs the communication operation in accordance with a predetermined communication standard. The communication section 14 transmits and receives data to and from the instructor terminal 20 and the exerciser terminal 30 via the network N.

Figure 3:
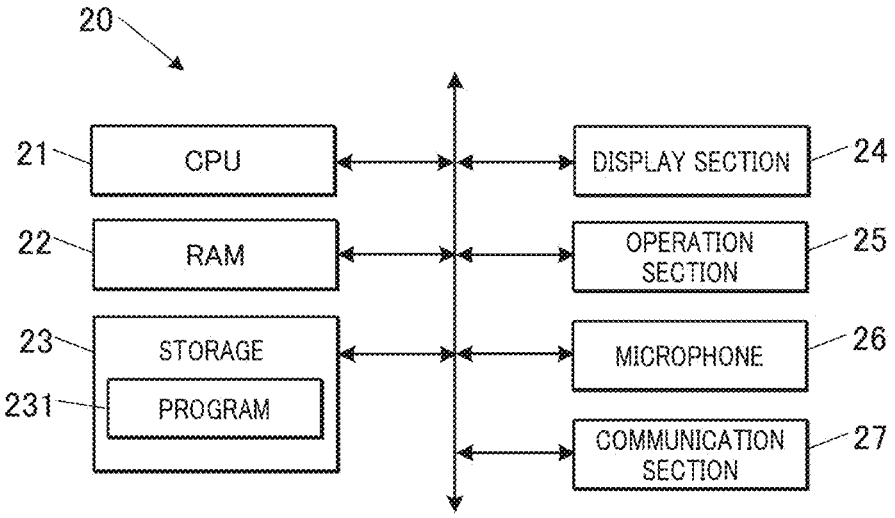
FIG. 3 is a block diagram showing the functional configuration of an instructor terminal.

FIG. 3 is a block diagram showing the functional configuration of the instructor terminal 20.

The instructor terminal 20 in the present embodiment is assumed to be a tablet type terminal. However, not limited to this, the instructor terminal 20 may be a smartphone, notebook PC, and the like. The instructor terminal 20 includes a CPU 21, a RAM 22, a storage 23, a display section 24, an operation section 25, a microphone 26, a communication section 27, and the like. Each part of the instructor terminal 20 is connected via a communication path such as a bus.

The CPU 21 processor that controls the operation of each part of the instructor terminal 20 by reading and executing a program 231 stored in the storage 23 and performing various arithmetic processing.

The RAM 22 provides a memory space for work to the CPU 21 and stores temporary data.

The storage 23 stores the program 231 and various data. The storage 23 includes, for example, a non-volatile memory such as an HDD, an SSD, and the like.

The display section 24 displays various information display screens such as an analysis setting screen 60 (see FIG. 5) and an analysis result screen 70 (see FIG. 10) based on control signals transmitted from the CPU 21. For example, a liquid crystal display device can be used as the display section 24.

The operation section 25 accepts an input operation from a user (instructor) and outputs an input signal corresponding to the input operation to the CPU 21. The operation section 25 includes a touch panel arranged superimposed on the display screen of the display section 24, and the touch panel detects contact of a user's finger or the like as an input operation. Also, the operation section 25 may include hardware buttons along with or in place of the touch panel.

The microphone 26 converts the input voice into voice data and outputs it to the CPU 21.

The communication section 27 performs a communication operation in accordance with a predetermined communication standard. The communication section 27 transmits and receives data to and from the server 10 via the network N by this communication operation.

Figure 4:
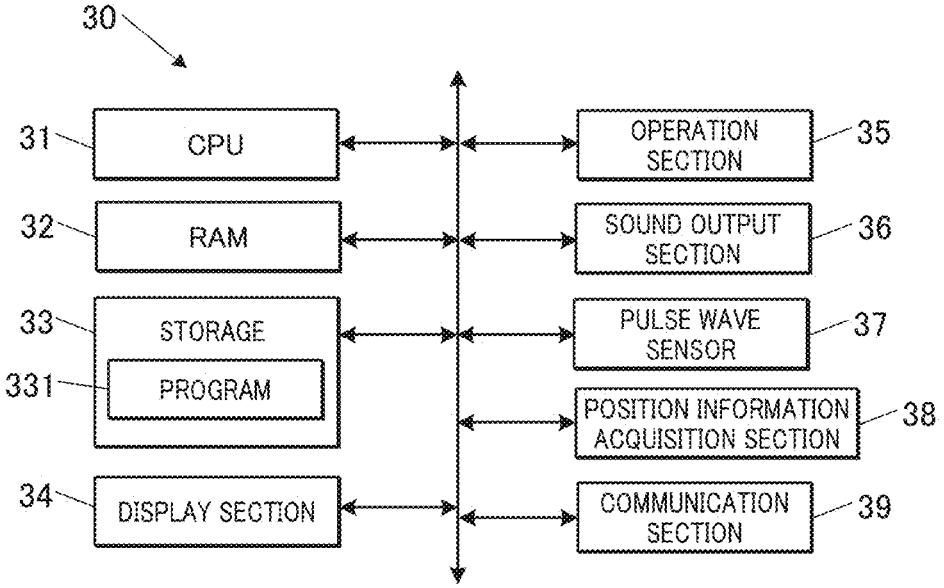
FIG. 4 is a block diagram showing the functional configuration of an exerciser terminal.

FIG. 4 is a block diagram showing the functional configuration of the exerciser terminal 30.

The exerciser terminal 30 is a device worn or carried and used by an exerciser during exercise, and in the present embodiment, it is a smart watch worn on the wrist for use. The exerciser terminal 30 may be a wearable or portable device such as a smartphone, activity meter, and the like. The exerciser terminal 30 includes a CPU 31, a RAM 32, a storage 33, a display section 34, an operation section 35, a sound output section 36, a pulse wave sensor 37, a position information acquisition section 38, a communication section 39, and the like. Each part of the exerciser terminal 30 is connected via a communication path such as a bus.

The CPU 31 is a processor that controls the operation of each part of the exerciser terminal 30 by reading and executing a program 331 stored in the storage 33 and performing various arithmetic processing.

The RAM 32 provides a memory space for work to the CPU 31 and stores temporary data.

The storage 33 stores the program 331 and various data. The storage 33 includes a nonvolatile memory such as a flash memory, for example.

The display section 34 displays various operation screens, information display screens, and the like, under control by the CPU 31. As the display section 34, for example, a liquid crystal display device that performs display using a dot matrix system can be used, but the display section 34 is not limited to this.

The operation section 35 accepts an input operation from a user (exerciser) and outputs an input signal corresponding to the input operation to the CPU 31. The operation section 35 includes a touch panel arranged superimposed on the display screen of the display section 34, and the touch panel detects contact of a user's finger or the like as an input operation. Also, the operation section 35 may include hardware buttons along with or in place of the touch panel.

The sound output section 36 includes a speaker and outputs voice and alarm sounds according to control signals transmitted from the CPU 31.

The pulse wave sensor 37 detects the exerciser's pulse wave. The pulse wave sensor 37 is a biological sensor that is indirectly attached to the exerciser by the exerciser wearing the exerciser terminal 30. The pulse wave sensor 37 includes a light emitting element that emits green light that is easily absorbed by hemoglobin in the blood from a surface in contact with the wrist of the exerciser terminal 30, and a light receiving element that receives light emitted from the light emitting element and reflected by the exerciser's skin. Since part of the light irradiated to the skin is absorbed by blood in blood vessels, the amount of light received by the light receiving element of light reflected from the skin changes over time in response to changes in blood flow associated with heart pulsation. The pulse wave sensor 37 detects pulse waves based on this change in the amount of light received, and outputs a waveform corresponding to the detected pulse waves to the CPU 31. The CPU 31 derives the heart rate (pulse rate) as biological information based on the waveform.

The position information acquisition section 38 receives and decodes transmission radio waves from positioning satellites of global positioning satellite systems (GNSS: Global Navigation Satellite System) such as GPS (Global Positioning System) and calculates the current position. The position information acquisition section 38 calculates the current position under control by the CPU 31 and outputs the result to the CPU 31. The sensor device 40 may include a position information acquisition section having a function similar to the position information acquisition section 38.

The communication section 39 performs a communication operation in accordance with a predetermined communication standard. The communication section 39 transmits and receives data to and from the server 10 via the network N by this communication operation. Also, the communication section 39 transmits and receives data by short-range wireless communication to and from the sensor device 40 and the earphone 50.

The sensor device 40 shown in FIG. 1 is a wearable terminal attached to an exerciser's body (for example, lower back) for use. The sensor device 40 has a CPU not shown, a 3-axis acceleration sensor that detects acceleration in the orthogonal three axis directions, a 3-axis angular velocity sensor that detects angular velocity around the three orthogonal axes, and a communication section. The CPU of the sensor device 40 derives index values (motion index values Ib: see FIG. 7) of various motion indices relating to body movements of an exerciser wearing the sensor device 40 based on the detection results of the 3-axis acceleration sensor and the 3-axis angular velocity sensor and transmits the derived results to the exerciser terminal 30 via the communication section. The sensor device 40 may transmit detection results of the 3-axis acceleration sensor and the 3-axis angular velocity sensor to the exerciser terminal 30, and the CPU 31 of the exerciser terminal 30 may derive the motion index values Ib.

The earphone 50 shown in FIG. 1 is attached to the exerciser's ear and used during exercise. The earphone 50 includes a CPU, a speaker, and a communication section not shown. When voice data is received from the exerciser terminal 30 via the communication section, the CPU of the earphone 50 outputs voice or alarm sound by the speaker based on the voice data.

(Operation of Information Processing System)

Next, the operation of the information processing system 1 will be explained.

The information processing system 1 can analyze the instruction voice (voice) transmitted from the instructor to the exerciser and specify what characteristics of the instruction voice are effective in instructing the exerciser. The outline of operations relating to the analysis of effective instruction voice is as follows.

The CPU 21 of the instructor terminal 20 converts the instruction voice transmitted from the instructor to the exerciser into voice data and transmits it to the server 10. The CPU 11 of the server 10 analyzes the characteristics (multiple characteristic items) of the instruction voice relating to the received voice data. Meanwhile, the CPU 31 of the exerciser terminal 30 repeatedly transmits state information Ia (see FIG. 7) representing the exercise state (action state) of the exerciser to the server 10 during exercise. The CPU 11 of the server 10 generates and updates voice transmission result data 134 (see FIG. 2 and FIG. 8) in which change in a certain motion index value Ib (state value) (see FIG. 7) of state information Ia before and after the transmission timing of the instruction voice is associated with multiple characteristic items of the transmitted instruction voice. Based on this voice transmission result data 134, the CPU 11 specifies characteristic items (hereinafter described as "effective characteristic items") and trends of the instruction voices that induce the change in the desired direction of the motion index value Ib after the instruction voice is transmitted. The CPU 11 of the server 10 transmits the analysis results of effective instruction voice including these specifying results to the instructor terminal 20 to display them on the instructor terminal 20. With these analysis results, the instructor can grasp the characteristics (effective characteristic items and their trends) of instruction voice effective for the exerciser and reflect them in the next instruction voice.

When the effective instruction voice is analyzed, an analysis setting screen 60 for performing settings relating to analysis is displayed on the instructor terminal 20. The analysis setting screen 60 is displayed on the display section 24 when a predetermined operation is performed on the operation section 25 by the instructor.

Figures 5, 6, 7:
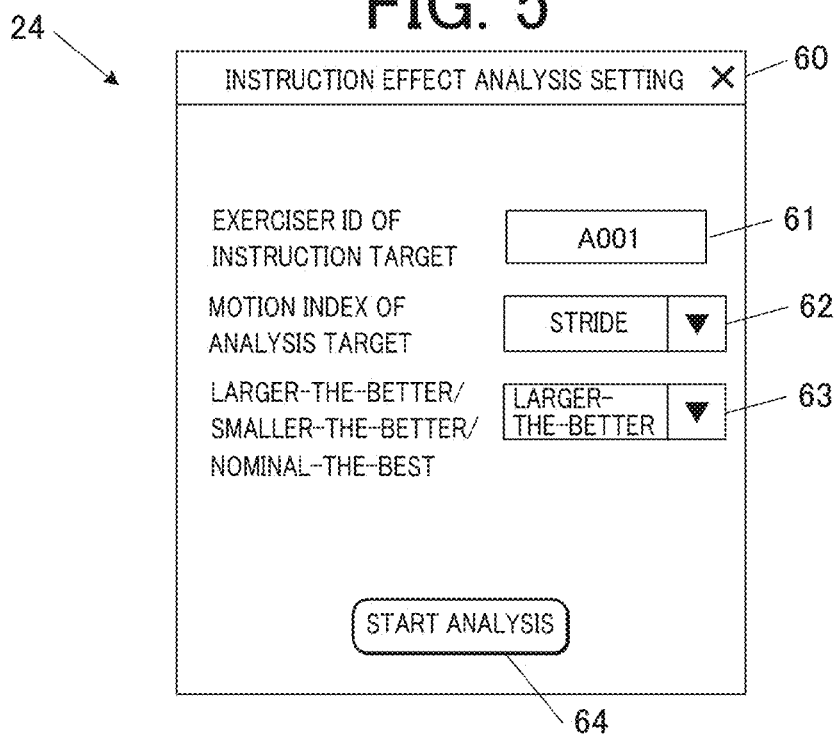
FIG. 5 is a diagram showing the contents of an analysis setting screen.
FIG. 6 is a diagram showing the contents of analysis setting data.
FIG. 7 is a diagram showing the contents of exercise data.

FIG. 5 is a diagram showing the contents of the analysis setting screen 60.

A text box 61, drop-down lists 62, 63, and an analysis start button 64 are displayed on the analysis setting screen 60.

The text box 61 is used to specify an exerciser of instruction target. The exerciser's exerciser ID is input into the text box 61. The exerciser ID is a unique code assigned to the exerciser in advance.

The drop-down list 62 is used to specify the motion index of analysis target. In FIG. 5, "stride" is selected as the motion index of analysis target.

The drop-down list 63 is used to specify whether the motion index of analysis target selected in the drop-down list 62 has a larger-the-better property, a smaller-the-better property, or a nominal-the-best property for which it is more desirable to be closer to a specific target value. In FIG. 5, "larger-the-better" which represents the larger-the-better property is selected. When the nominal-the-best property is selected, an illustrated text box (not shown) for inputting the target value is further displayed.

When the analysis start button 64 is selected, the input content of the text box 61 at that point and the data of selected contents in the drop-down lists 62, 63 are transmitted from the instructor terminal 20 to the server 10, and analysis setting data 132 is generated in the server 10 based on the data. Below, in the present embodiment, as shown in FIG. 5, the operation when "stride" which has a larger-the-better property is specified as the motion index of analysis target is explained as an example.

FIG. 6 is a diagram showing the contents of the analysis setting data 132.

The specified motion index of analysis target and its category of larger-the-better property, smaller-the-better property, or nominal-the-best property are registered in the analysis setting data 132. Also, a body site (hereinafter also described as "first site") directly related to the motion index of analysis target is registered in the analysis setting data 132. For example, when the motion index is "stride," the first site directly related to this is the "legs". The first site directly related to the motion index is predetermined for each motion index and stored in the storage 13.

The analysis of effective instruction voice is started in response to the selection of the analysis start button 64. When the analysis is started, the CPU 11 of the server starts receiving state information Ia from the exerciser terminal 30. The state information Ia is repeatedly transmitted from the exerciser terminal 30 at a predetermined timing (for example, every predetermined time or every time the exerciser runs a predetermined distance). The CPU 11 of the server 10 registers the received state information Ia in the exercise data 133.

FIG. 7 is a diagram showing the contents of the exercise data 133.

Each data line of the exercise data 133 corresponds to the state information Ia representing the state of the exerciser at a certain point during exercise.

The "exerciser ID" in each state information Ia is the exerciser ID of the exerciser performing the exercise.

The "time" represents the date and time when the state information Ia was generated.

The "position" represents the position (here, north latitude and east longitude) of the exerciser terminal 30 at the time the state information Ia is generated. The "position" data is acquired by a position information acquisition section 38 of the exerciser terminal 30.

The "running distance" represents the distance traveled by an exerciser from the start of exercise until the time the state information Ia is recorded. The "running distance" data is derived based on change in positioning results according to the position information acquisition section 38.

The "velocity" represents the velocity of the exerciser at the time the state information Ia is recorded. Pace may be used in place of velocity.

The "heart rate" represents the heart rate of the exerciser at the time the state information Ia is recorded. As described above, the "heart rate" data is derived based on the exerciser's pulse wave detected by the pulse wave sensor 37.

The "motion index" is various indices representing the exercise state of the exerciser, and "stride," "vertical movement," and "ground contact time" are exemplified here. As described above, the values of respective motion indices (motion index values Ib) are derived based on detection results such as acceleration by the sensor device 40. The motion index is not limited to those exemplified in FIG. 7, and may include, for example, backward tilt angle of the trunk, lower back sinking, pelvic rotation, left and right impact, kicking time, landing impact, kicking acceleration, deceleration amount, and the like.

Meanwhile, when the analysis start button 64 is selected, the CPU 21 of the instructor terminal 20 transmits a control signal to the microphone 26 to shift to a state where input of the instruction voice by the instructor is accepted. Then, when the instruction voice is input to the microphone 26, the instruction voice is converted into voice data by the microphone 26 and output to the CPU 21. The CPU 21 transmits the voice data to the server 10.

The CPU 11 of the server 10 transmits the received voice data to the exerciser terminal 30, to cause the earphone 50 or the sound output section 36 to output (transmit) the instruction voice to the exerciser. Specifically, here, the CPU 31 of the exerciser terminal 30 that has received the voice data transmits the voice data to the earphone 50 or outputs it to the sound output section 36, so that the instruction voice is output by the earphone 50 or the sound output section 36. When the exerciser can directly hear the instructor's instruction voice, such as when the distance between the instructor and the exerciser is close, the transmission of voice data from the server 10 to the instructor terminal 20 and the output operation of the instruction voice by the earphone 50 and the sound output section 36 may be omitted.

Also, the CPU 11 of the server 10 analyzes the characteristics of the instruction voice relating to the voice data received from the instructor terminal 20 by using various known analysis methods and registers the analysis results in the voice transmission result data 134.

FIG. 8 is a diagram showing the contents of voice transmission result data 134.

Each data line of voice transmission result data 134 is equivalent to transmitted voice information Ic corresponding to instruction voice once transmitted to the exerciser.

The "voice ID" of each transmitted voice information Ic is a unique code assigned to each instruction voice.

The "target exerciser ID" is the exerciser ID of the exerciser of instruction target designated by the text box 61 on the analysis setting screen 60.

The "time" is the time (transmission timing) when the instruction voice of the data line is transmitted to the exerciser.

The "characteristic items of voice" include multiple characteristic items representing the characteristics of the analyzed instruction voice. Here, the multiple characteristic items include "volume," "intensity of emotion," "range of change in intonation," and "semantic content."

The "volume" represents the loudness of the instruction voice with an integer in 5 levels from the smallest "−2" to the largest "+2."

The "intensity of emotion" represents the strength of emotion contained in the instruction voice with an integer in 5 levels from the weakest "−2" to the strongest "+2."

The "range of change in intonation" represents the range of change in intonation (pitch of voice) of the instruction voice with an integer in 5 levels from the smallest "−2" to the largest "+2."

The "semantic content" also has sub-items of "instruction method," "positive/negative," and "message."

The "instruction method" represents whether the instruction method of the instruction voice is "direct" or "indirect." In the case of "direct," the value is "+2," and in the case of "indirect," the value is "−2." Here, "direct" represents direct instruction targeting the first site directly related to the motion index of instruction target. Also, "indirect" represents instruction targeting a second site which is correlated with the first site and is different from the first site. When the motion index of instruction target is "stride," as described above, the first site is the legs, and the second site is, for example, arms, or the like. In this case, the direct instruction is instruction that directly increases the stride by targeting the legs, such as "Raise your legs higher." On the other hand, the indirect instruction is instruction that t indirectly increases the stride by making the exerciser aware of arm movements, such as "Swing your arms widely."

The "positive/negative" represents whether the instruction voice has positive contents or negative contents. Examples of positive instruction voices include voices that do not include negative expressions, such as "Raise your legs higher." Also, examples of negative instruction voices include voices containing negative expressions, such as "Your back isn't straight". In the case of "positive," the value is "+2," and in the case of "negative," the value is "−2."

The "message" is the words of the instruction voice converted into text data.

The CPU 11 of the server 10 analyzes voice data of instruction voices using various well-known analysis methods capable of specifying the contents of each characteristic item described above in voice transmission result data 134. In other words, "volume," "intensity of emotion," and "range of change in intonation" are specified based on analysis results such as the volume and its change of the instruction voice, the pitch and its change of the sound, and the like. Also, words included in the instruction voice are extracted from the voice data, whether the instruction target is the first site or the second site is specified from semantic contents of the words, and the contents of the "instruction method" are specified. Also, "positive/negative" content is specified from the semantic contents of the words. The method for analyzing voice data of instruction voices is not particularly limited, but may include, for example, processing for specifying at least one of "volume," "intensity of emotion," and "range of change in intonation" based on the amplitude of the voice waveform in the voice data and its time series changes. Also, the method for analyzing the voice data may include processing for specifying "intensity of emotion" and/or "range of change in intonation" by decomposing voice waveforms in the voice data into frequency components by Fourier transformation and analyzing the obtained spectrum. Also, there may be included processing of acquiring text data of the instruction voice by inputting the voice data to a machine learning model that has been machine-learned so as to output text data of instruction voice in response to voice data input (that is, to perform voice recognition), and based on the obtained text data, specifying "instruction method" and/or "positive/negative" content. Also, by using a machine learning model that has been machine-learned to directly output "instruction method" and/or "positive/negative" content, the "instruction method" and/or "positive/negative" content may be directly acquired from the machine learning model. Also for "volume," "intensity of emotion," and "range of change in intonation," the contents of these characteristic items may be acquired from the machine learning model by inputting the voice data to the machine learning model that has been machine-learned to output these characteristic items in response to the voice data input. The machine learning model used for analyzing the voice data may be provided in the storage 13 of the server 10, or may be provided in an external device connected directly to the server 10 or via the network N. The CPU 11 specifies the characteristic items of voice in this way and registers the specified values and the output text data in the voice transmission result data 134.

Each transmitted voice information Ic in the voice transmission result data 134 further includes "stride change rate" data. The "stride change rate" represents the change rate in the stride motion index value Ib before and after the transmission timing of the instruction voice. Though the change rate is used here, an amount of change may be used in place of the change rate. The rate or amount of change in stride is equivalent to "change in state value."

Figure 9:
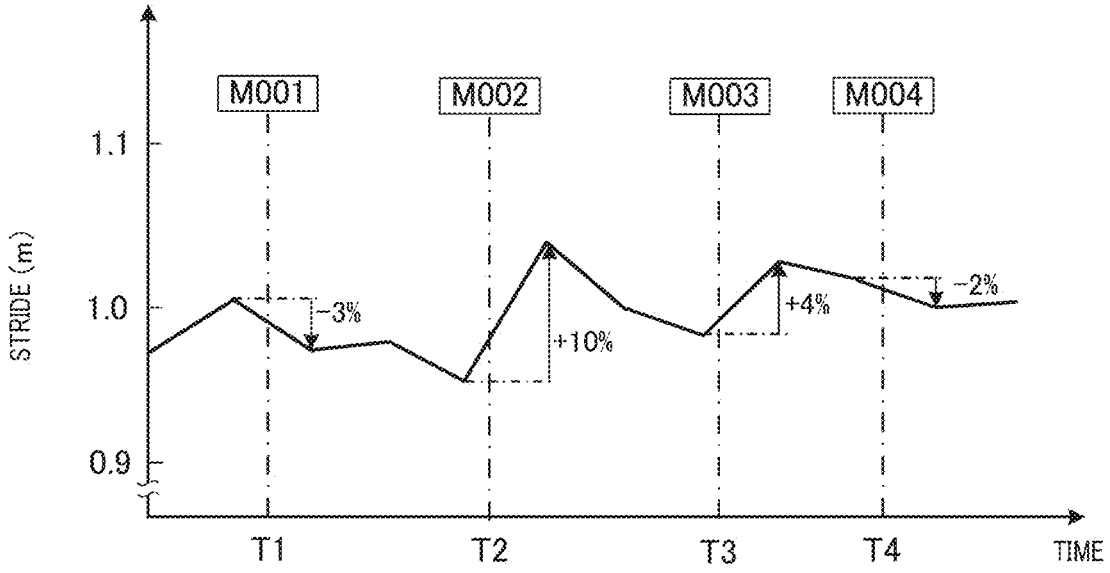
FIG. 9 is a diagram explaining a stride change rate.

FIG. 9 is a diagram explaining the stride change rate.

The graph shown in FIG. 9 plots time series changes in stride values in the exercise data 133. Also, times T1, T2, T3, and T4 are the times when the instruction voices of respective voice IDs "M001," "M002," "M003," and "M004" in the voice transmission result data 134 in FIG. 8 were transmitted. As can be seen from the graph, the value of the stride first measured after time T1 is decreased by 3% compared to the value of the last measured stride before time T1. In other words, the stride value is decreased by 3% before and after time T1. Similarly, the stride value is increased by 10% before and after time T2, increased by 4% before and after time T3, and decreased by 28 before and after time T4. This rate of increase or decrease is registered in the "stride change rate" of the voice transmission result data 134. Thus, the "stride change rate" represents the extent to which the stride has increased or decreased due to the instruction voice of the transmitted voice information Ic. The stride value used to derive the increase rate and decrease rate may not be the value first recorded after the transmission time of the instruction voice and may also be the value first recorded after a predetermined time has elapsed after the transmission time. That is, the increase rate and decrease rate may be derived based on motion index values Ib before and after a predetermined period including the transmission time of the instruction voice.

When multiple transmitted voice information ICs are registered in the voice transmission result data 134, the CPU 11 of the server 10 specifies at least one characteristic item and a trend of the characteristic item (effective characteristic item and its trend) that induce an increase in stride (change in a desired direction) among the multiple characteristic items according to a predetermined analysis algorithm.

As an analysis algorithm, for example, multiple regression analysis can be used. Below, the stride change rate before and after time Tn (n is a natural number from 1 to N, N is the number of transmitted voice information ICs included in the voice transmission result data 134) is $R_{Tn}$. When multiple regression analysis is used, the CPU 11 derives coefficients $w_0$ to $w_5$ such that the objective function L represented by formula (2) is minimized when the predicted value $r_{Tn}$ of the stride change rate $R_{Tn}$ at time Tn is expressed by the following multiple regression equation (1).

$$r_{Tn} = w_1x_1 + w_2x_2 + w_3x_3 + w_4x_4 + w_5x_5 + w_0x_0 \quad (1)$$

$$L = (R_{T1} - r_{T1})^2 + (R_{T2} - r_{T2})^2 + \ldots + (R_{Tn} - r_{Tn})^2 \quad (2)$$

Here, $x_0$ to $x_5$ are explanation variables, and $w_0$ to $w_5$ are coefficients of explanation variables. The coefficients $w_0$ to $w_5$ can also be paraphrased as the weight of the explanation variables $x_0$ to $x_5$. The explanation variables $x_1$ to $x_5$ correspond to the five characteristic items in the transmitted voice information Ic. Specifically, the explanation variable $x_1$ is the value of "volume" in the transmitted voice information Ic corresponding to the time Tn. The explanation variable $x_2$ is the value of "intensity of emotion" in the transmitted voice information Ic corresponding to the time Tn. The explanation variable $x_3$ is the value of the "range of change in intonation" in the transmitted voice information Ic corresponding to the time Tn. The explanation variable $x_4$ is the value of the "instruction method" in the transmitted voice information Ic corresponding to the time Tn. The explanation variable $x_5$ is the "positive/negative" value in the transmitted voice information Ic corresponding to the time Tn. The explanation variable $x_0$ is a constant "1," and the term "$w_0x_0$" is equal to the coefficient $w_0$. Thus, the coefficient $w_0$ is equivalent to the bias of multiple regression equation (1).

The CPU 11 specifies coefficients satisfying predetermined conditions relating to the magnitude of the absolute value of the coefficient among the derived coefficients $w_1$ to $w_5$ and specifies explanation variables corresponding to the specified coefficients as effective characteristic items. The predetermined condition relating to the magnitude of absolute values can be determined as appropriate. For example, the predetermined condition may be that the absolute value of the coefficient is a predetermined threshold value or greater. Also, the predetermined condition may be within the upper predetermined number of coefficients when the coefficients $w_1$ to $w_5$ are arranged in descending order according to absolute values.

Also, the CPU 11 specifies trends of effective characteristic items that induce the change (here, increase) in the desired direction of stride from the code of the specified coefficient. Here, the desired direction is the direction corresponding to the "larger-the-better/smaller-the-better/nominal-the-best" setting in the analysis setting data 132. The desired direction is the direction of increasing in the case of larger-the-better, the direction of decreasing in the case of smaller-the-better, and the direction toward the target value in the case of nominal-the-best.

When a coefficient is positive, it represents that the stride change rate tends to increase in response to an increase in explanation variable (characteristic item) corresponding to the coefficient. Also, it represents that the larger the absolute value of the coefficient, the easier it is for the stride change rate to increase in response to an increase in explanation variable.

Also, when a certain coefficient is negative, it represents that the stride change rate tends to increase in response to a decrease in explanation variable (characteristic item) corresponding to the coefficient. Also, it represents that the larger the absolute value of the coefficient, the easier it is for the stride change rate to increase in response to a decrease in explanation variable.

For example, when voice transmission result data 134 shown in FIG. 8 is analyzed by multiple regression analysis, the coefficient $w_1$ corresponding to the explanation variable $x_1$ of "volume" becomes positive. This is because when focusing on the transmitted voice information Ic of the voice IDs "M002" and "M003," there is a correlation that the stride change rate increases when the value of "volume" is large. Therefore, when the coefficient $w_1$ satisfies the predetermined conditions described above and "volume" is specified as an effective characteristic item, the CPU 11 specifies a trend that "the higher the value, the easier it is for the stride change rate to increase" with respect to the characteristic item of "volume."

Also, when the above analysis is performed, the coefficient $w_4$ corresponding to the explanation variable $x_4$ of the "instruction method" becomes negative. This is because when focusing on the transmitted voice information Ic of the voice IDs "M002" and "M003," there is a correlation that the stride change rate increases when the value of the "instruction method" is small (that is, it is indirect instruction). Therefore, when the coefficient $w_4$ satisfies the predetermined conditions described above and the "instruction method" is specified as an effective characteristic item, the CPU 11 specifies a trend that "the stride change rate easily increases when the value is small (that is, the instruction method is "indirect")" with respect to the characteristic item of the "instruction method".

In the present embodiment, the range of values that can be taken for each explanation variable $x_1$ to $x_5$ (characteristic item) is arranged from −2 to +2. However, the range of values that can be taken for each explanation variable $x_1$ to $x_5$ may be adjusted in advance so that the absolute values of the derived coefficients $w_1$ to $w_5$ indicate appropriate analysis results.

Also, when analysis based on the same analysis setting data 132 has been performed in the past, in addition to the transmitted voice information Ic generated during execution of the current analysis, the transmitted voice information Ic used for past analysis may be added to the voice transmission result data 134 and used for analysis of multiple regression analysis.

Effective characteristic items and their trends may be specified using a machine learning model 135. The machine learning model 135 is machine learned to output information relating to effective characteristic items and their trends by inputting voice transmission result data 134 (multiple transmitted voice information Ic). By inputting voice transmission result data 134 including the latest transmitted voice information Ic which was generated to the machine learning model 135, the CPU 11 can specify effective characteristic items and their trends based on output from the machine learning model 135. The algorithm used by the machine learning model 135 to specify effective characteristic items and their trends may use multiple regression analysis described above or may be an algorithm separate from this. The configuration of the machine learning model 135 is not particularly limited, but may, for example, use a neural network or support vector machine. Also, the machine learning model 135 may be provided on an external device connected to the server 10 via the network N.

When effective characteristic items and their trends are specified, the CPU 11 transmits analysis result data including the specifying results to the instructor terminal 20 to display the analysis result screen 70 on the display section 24 of the instructor terminal 20.

Figure 10:
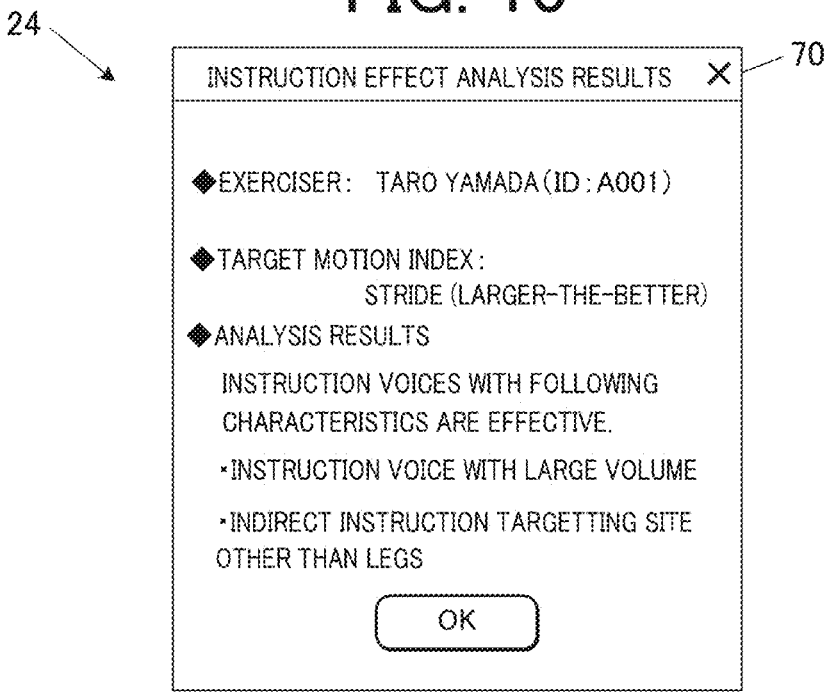
FIG. 10 is a diagram showing the contents of an analysis result screen.

FIG. 10 is a diagram showing the contents of the analysis result screen 70.

In FIG. 10, analysis results based on voice transmission result data 134 shown in FIG. 8 are shown as an example. Based on the results of the multiple regression analysis described above, advice is displayed on the analysis result screen 70 to advise that the stride change rate can be effectively increased by increasing the "volume" of voice and making the "instruction method" "indirect". On the analysis result screen 70, examples of specific instruction voice words (for example, sentences) in accordance with the above advice may be presented.

The timing for displaying the analysis result screen 70 can be determined as appropriate. For example, the analysis result screen 70 may be displayed every time the instructor transmits an instruction voice. Alternatively, the analysis result screen 70 may be displayed when the number of registered transmitted voice information Ic in the voice transmission result data 134 becomes equal to or greater than the lower limit for obtaining reasonable analysis results.

Next, instruction effect analysis processing performed by the CPU 11 of the server 10 to achieve the operation described above is explained.

Figure 11:
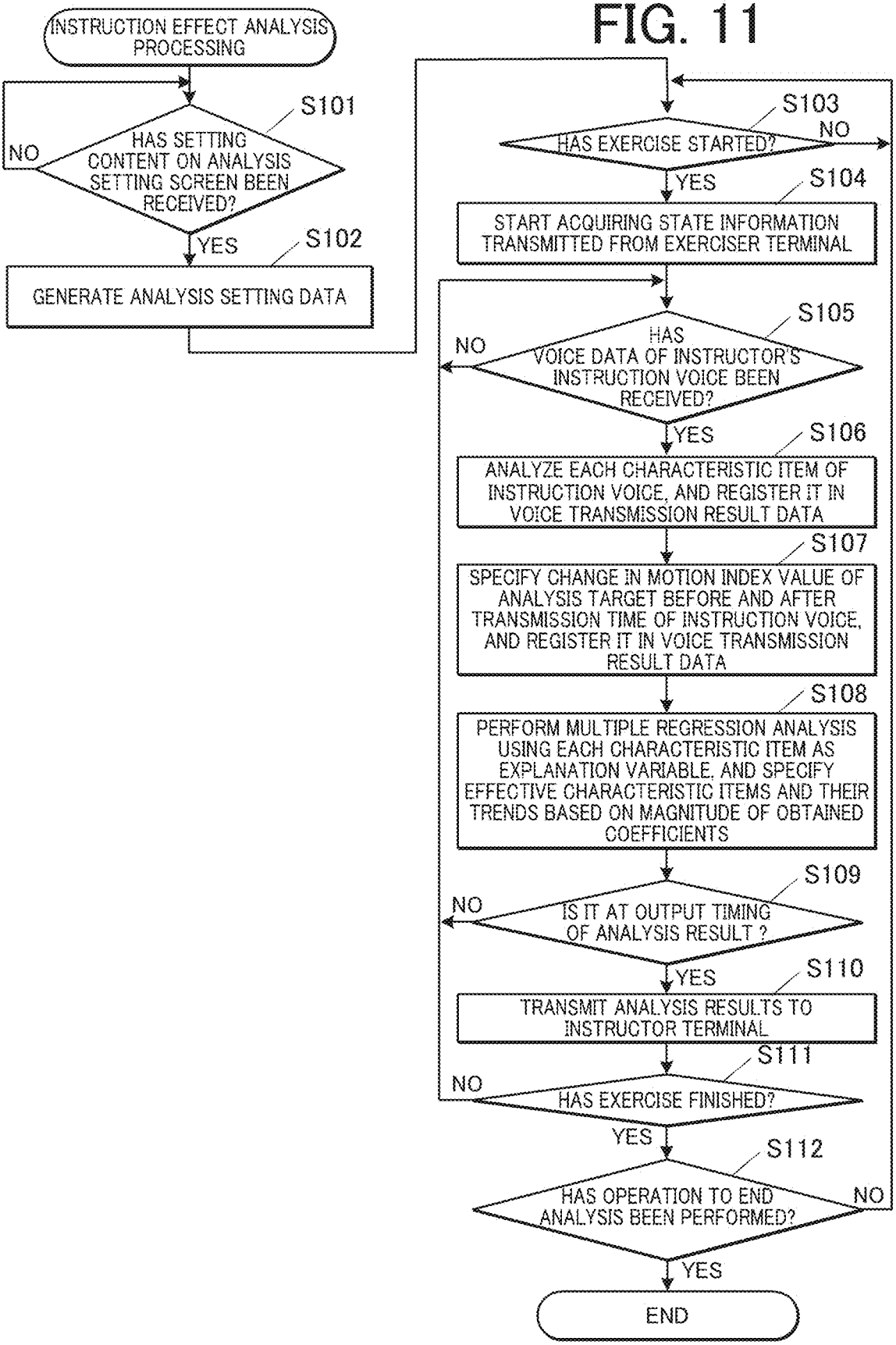
FIG. 11 is a flow chart showing a control procedure of instruction effect analysis processing.

FIG. 11 is a flow chart showing a control procedure for instruction effect analysis processing.

The instruction effect analysis processing is started in response to, for example, a predetermined operation performed to start analysis of effective instruction voice in the instructor terminal 20, and a predetermined notification made from the instructor terminal 20 to the server 10.

When the instruction effect analysis processing is started, the CPU 11 of the server 10 repeatedly determines whether data on the setting content on the analysis setting screen 60 has been received from the instructor terminal 20 (step S101). If it is determined that the data has been received ("YES" in step S101), the CPU 11 generates analysis setting data 132 based on the received data (step S102).

The CPU 11 repeatedly determines whether an exercise of the exerciser has started (step S103). For example, the CPU 11 determines that the exercise has started when receiving predetermined notification data from the exerciser terminal 30. If it is determined that the exercise has started ("YES" in step S103), the CPU 11 starts acquiring state information Ia which is repeatedly transmitted from the exerciser terminal 30 (step S104).

The CPU 11 repeatedly determines whether voice data of the instructor's instruction voice has been received from the instructor terminal 20 (step S105). If it is determined that the voice data of the instruction voice has been received ("YES" in step S105), the CPU 11 analyzes each characteristic item of the instruction voice according to the setting content of the analysis setting data 132 and registers it in the voice transmission result data 134 (step S106). For example, when the motion index of analysis target is set to "stride" in the analysis setting data 132, the CPU 11 determines whether the characteristic item of "instruction method" is "direct" or "indirect" based on whether the instruction content of the instruction voice targets the legs. Also, the CPU 11 refers to the exercise data 133, specifies the change in motion index value of analysis target (stride change rate in the present embodiment) before and after the transmission time of the instruction voice, and registers it in the voice transmission result data 134 (step S107).

Using the method described above, the CPU 11 performs multiple regression analysis using the value of each characteristic item as the explanation variable and specifies effective characteristic items and their trends based on the magnitude of the obtained coefficient of each explanation variable (step S108).

The CPU 11 determines whether it is at a predetermined output timing of the analysis results (step S109). If it is not determined as being at the output timing ("NO" in step S109), the CPU 11 returns the processing to step S105. If it is determined as being at the output timing ("YES" in step S109), the CPU 11 transmits data relating to the analysis results to the instructor terminal 20 to display the analysis result screen 70 on the display section 24 of the instructor terminal 20 (step S110).

The CPU 11 determines whether the exercise of the exerciser has finished (step S111). If it is determined that the exercise has not finished ("NO" in step S111), the CPU 11 returns the processing to step S105. If it is determined that the exercise has been finished ("YES" in step S111), the CPU 11 determines whether an operation to end the analysis of the instruction voice has been performed in the instructor terminal 20 (step S112). If it is determined that the operation has not been performed ("NO" in step S112), the CPU 11 returns the processing to step S103. If it is determined that the operation has been performed ("YES" in step S112), the instruction effect analysis processing is ended.

(Effects)

In conventional technology where voices of instruction, encouragement, and the like are output from a terminal device to a target person during exercise to support the target person's exercise, whether or not support with the output voice is effective has differences between individuals, and differs by the target person. Therefore, with the above technology, there is an issue that it is not easy to provide effective support to the target person.

With respect to this, in the information processing method according to the present embodiment, the CPU 11 of the server 10 specifies the characteristics of the instruction voice that induces the change in motion index value Ib based on the voice transmission result data 134 in which the change in the motion index value Ib representing the exercise state of the exerciser before and after each transmission timing of multiple instruction voices s transmitted to the exerciser during exercise is associated with the characteristics of each of the multiple instruction voices. Thus, it is possible to present, to the instructor, characteristics of instruction voices capable of providing effective instruction (support) to the exerciser. As a result, it is possible to provide support suitable for the exerciser. For example, it is possible for the instructor to perform effective instruction by voices having characteristics suitable for the exerciser.

Also, by specifying the characteristics of voices that induce the change in the motion index value Ib in a desired direction, the CPU 11 can present, to the instructor, the characteristics of instruction voices capable of imparting intended effects to the exerciser.

Also, the voice transmission result data 134 includes information relating to multiple characteristic items representing the characteristics of each instruction voice, specified based on the voice data of each of the multiple instruction voices, and the CPU 11 specifies at least one characteristic item and the trend of the characteristic item that induce the above change from among the multiple characteristic items based on the voice transmission result data 134. Thus, it is possible to present specific and appropriate advice to the instructor, such as which characteristic items of instruction voices and in what mode they are effective in instructing the exerciser.

Also, the multiple characteristic items include at least one item among the degree of volume of the instruction voice, the intensity of the emotion of the speaker (instructor) of the instruction voice, the range of change in intonation of the instruction voice, and the semantic content of the instruction voice. Thus, it is possible to present specifically what kind of instruction voice is effective to the instructor in an easy-to-understand manner.

Also, by using the motion index value Ib of the motion index representing the body movement of the exerciser performing the exercise as the state value representing the action state, it is possible to present accurate analysis results based on the change in actual body movement of the exerciser in response to the instruction voice.

Also, the multiple characteristic items include an item of semantic content of the instruction voice, the item being an "instruction method" item representing the distinction regarding whether the instruction targets the first site of the body directly related to the motion index or targets the second site different from the first site and correlated with the movement of the first site. Thus, it is possible to specify and present, to the instructor, whether the instruction voice targeting the first site (for example, legs) directly related to the motion index (for example, stride) of analysis target is effective or whether the instruction voice that performs indirect instruction targeting the second site (for example, arms) different from the first site is effective.

Also, the CPU 11 may specify the effective characteristic items and their trends by inputting the voice transmission result data 134 to the machine learning model 135 that has been machine-learned to output information relating to effective characteristic items and their trends in response to input of the voice transmission result data 134. Thus, analysis results can be obtained by simple processing for inputting data to the machine learning model 135.

Also, the information processing method according to the present embodiment specifies the characteristics of the instruction voice that induces the change in motion index value Ib based on the voice transmission result data 134 in which the change in the motion index value Ib representing the exercise state of the exerciser before and after each transmission timing of multiple instruction voices transmitted to the exerciser during exercise is associated with the characteristics of each of the multiple instruction voices. Thus, support suitable for the exerciser can be provided.

Also, the program 131 according to the present embodiment causes the CPU 11 to specify the characteristics of the instruction voice that induces the change in motion index value Ib based on the voice transmission result data 134 in which the change in the motion index value Ib representing the exercise state of the exerciser before and after each transmission timing of multiple instruction voices transmitted to the exerciser in action is associated with the characteristics of each of the multiple instruction voices. Thus, support suitable for the exerciser can be provided.

Also, the information processing system 1 according to the present embodiment includes: the instructor terminal 20 that accepts input of multiple instruction voices transmitted to the exerciser during exercise; the exerciser terminal 30 that is worn or carried for use by the exerciser and acquires the motion index value Ib representing the exercise state of the exerciser before and after each transmission timing of the multiple instruction voices; and the server 10 having the CPU 11 that specifies the characteristics of the instruction voice that induces the change in motion index value Ib based on the voice transmission result data 134 in which the change in the motion index value Ib is associated with the characteristics of each of the multiple instruction voices. Thus, support suitable for the exerciser can be provided.

(Others)

The present disclosure is not limited to the above embodiment, and various changes are possible.

For example, the CPU 21 of the instructor terminal 20 may execute the processing performed by the CPU 11 of the server 10 in the above embodiment. In this case, the instructor terminal 20 is equivalent to the information processing device, and the CPU 21 is equivalent to the "at least one processor". Also, the server 10 can be omitted.

Also, in the above embodiment, exercise is exemplified as a mode of the action, and the exerciser performing exercise as a mode of the target person in action is exemplified, but the action and the target person are not limited to them. For example, the target person may be a learner who performs learning as action, and in this case, it is possible to specify characteristics of instruction voice that improves the state value representing the learner's learning effect.

Also, the motion index of analysis target is not limited to "form indices" representing forms of exercise, such as stride, vertical movement, and ground contact time. Any item (for example, velocity or heart rate) included in the state information Ia may be used as the motion index of analysis target.

Also, in the above embodiment, a single motion index (stride) as an analysis target is taken as an example and explained, but the analysis target is not limited to this. Multiple motion indices may also be the analysis target. For example, one evaluation value (state value) relating to multiple motion indices may be derived by a method such as assigning the value of each motion index to a predetermined function using multiple motion indices as variables, and characteristics of voices that induce change in this evaluation value in a desired direction may be specified. For example, the above function is preferably determined so that the value of the function is larger for the larger value of the motion index with the larger-the-better property, the value of the function is larger for the smaller value of the motion index with the smaller-the-better property, and the value of the function is larger for the value of the motion index with the nominal-the-best property closer to the target value.

Also, in the above embodiment, analysis of the effective instruction voice is performed during exercise of the exerciser. Instead of this, analysis may be performed with desired analysis settings based on the exercise data 133 and voice data of the instruction voice acquired in the past at any timing other than during exercise.

Also, in the above embodiment, effective characteristic items and their trends are specified using the multiple regression analysis method, but the analysis method is not limited to this. For example, multivariate analysis other than multiple regression analysis may be used.

Also, in the above explanation, an example of using the HDD and SSD of the storage 13 as computer-readable media of programs according to the present disclosure is disclosed, but the media are not limited to this example. Information recording media such as flash memory or CD-ROM can be applied as other computer-readable media. Also, a carrier wave (carrier wave) is also applied to the present disclosure as a medium for providing program data according to the present disclosure via a communication line.

Also, the detailed configuration and detailed operation of each component of the information processing system 1 in the above embodiment can be appropriately changed to the extent that it does not deviate from the gist of the present disclosure.

Although the embodiment of the present disclosure has been described, the scope of the present disclosure is not limited to the above-described embodiment but includes the scope of the claims and their equivalents.

The invention claimed is:

1. An information processing method executed by an information processing device including a memory in which a program is stored and at least one processor, the method being executed under control of the at least one processor executing the program, and the method comprising:

storing, by the processor in the memory, a state value representing an action state of a target person in action, the state value being derived based on detection results output by a sensor device; and specifying, by the processor based on stored correspondence information, a characteristic item of a voice that induces a change in the state value, the correspondence information associating the change in the state value from before to after a respective transmission timing of a voice from among multiple voices transmitted to the target person in action with multiple characteristic items representing characteristics of each of the multiple voices, and the multiple characteristic items being specified based on voice data of each of the multiple voices, wherein the specifying comprises specifying, based on the correspondence information, (i) at least one characteristic item that induces the change in the state value, from among the multiple characteristic items, and (ii) a trend of the at least one characteristic item.

2. The information processing method according to claim 1, wherein the change in the state value is a change in a desired direction.

3. The information processing method according to claim 1, wherein the multiple characteristic items include a degree of a volume of the voice, an intensity of emotion of a speaker of the voice, a range of a change in intonation of the voice, and a semantic content of the voice.

4. The information processing method according to claim 1, wherein:

the action is an exercise, and the state value is a motion index value of a motion index representing a body movement of the target person performing the exercise.

5. The information processing method according to claim 1, wherein:

the action is an exercise, the state value is a motion index value of a motion index representing a body movement of the target person performing the exercise, the voice is an instruction voice for changing the motion index value of the target person performing the exercise in a desired direction, and the multiple characteristic items include an item of a semantic content of the voice representing a distinction regarding whether an instruction targets a first site of a body that is directly related to the motion index or targets a second site that is different from the first site and correlated with a movement of the first site.

6. The information processing method according to claim 1, wherein the processor specifies the at least one characteristic item and the trend of the characteristic item by inputting the correspondence information to a machine learning model that has been machine-learned to output information relating to the at least one characteristic item and the trend of the characteristic item that induce the change in the state value in response to input of the correspondence information.

7. An information processing device comprising at least one hardware processor operably coupled to a memory, the processor being configured to execute processes comprising:

storing, in the memory, a state value representing an action state of a target person in action, the state value being derived based on detection results output by a sensor device; and specifying, based on stored correspondence information, a characteristic item of a voice that induces a change in the state value, the correspondence information associating the change in the state value from before to after a respective transmission timing of a voice from among multiple voices transmitted to the target person in action with multiple characteristic items representing characteristics of each of the multiple voices, and the multiple characteristic items being specified based on voice data of each of the multiple voices, wherein the specifying comprises specifying, based on the correspondence information, (i) at least one characteristic item that induces the change in the state value, from among the multiple characteristic items, and (ii) a trend of the at least one characteristic item.

8. The information processing device according to claim 7, wherein the change in the state value is a change in a desired direction.

9. The information processing device according to claim 7, wherein the multiple characteristic items include a degree of a volume of the voice, an intensity of emotion of a speaker of the voice, a range of a change in intonation of the voice, and a semantic content of the voice.

10. The information processing device according to claim 7, wherein:

the action is an exercise, and the state value is a motion index value of a motion index representing a body movement of the target person performing the exercise.

11. The information processing device according to claim 7, wherein;

the action is an exercise, the state value is a motion index value of a motion index representing a body movement of the target person performing the exercise, the voice is an instruction voice for changing the motion index value of the target person performing the exercise in a desired direction, and the multiple characteristic items include an item of a semantic content of the voice representing a distinction regarding whether an instruction targets a first site of a body that is directly related to the motion index or targets a second site that is different from the first site and correlated with a movement of the first site.

12. The information processing device according to claim 7, wherein the processor specifies the at least one characteristic item and the trend of the characteristic item by inputting the correspondence information to a machine learning model that has been machine-learned to output information relating to the at least one characteristic item and the trend of the characteristic item that induce the change in the state value in response to input of the correspondence information.

13. A non-transitory computer-readable recording medium having a program recorded thereon, the program being executable by at least one hardware processor operably coupled to a memory, and the program causing the processor to execute processes comprising:

storing, in the memory, a state value representing an action state of a target person in action, the state value being derived based on detection results output by a sensor device; and specifying, based on stored correspondence information, a characteristic item of a voice that induces a change in the state value, the correspondence information associating the change in the state value from before to after a respective transmission timing of a voice from among multiple voices transmitted to the target person in action with multiple characteristic items representing characteristics of each of the multiple voices, and the multiple characteristic items being specified based on voice data of each of the multiple voices, wherein the specifying comprises specifying, based on the correspondence information, (i) at least one characteristic item that induces the change in the state value, from among the multiple characteristic items, and (ii) a trend of the at least one characteristic item.

14. An information processing system comprising:

a first terminal device that accepts input of multiple voices to be transmitted to a target person in action;

a second terminal device that is worn or carried for use by the target person and that acquires a state value representing an action state of the target person, the second terminal device comprising a sensor device, and the state value being derived based on detection results output by the sensor device; and an information processing device including at least one hardware processor operably coupled to a memory, the processor being configured to execute processes comprising:

storing, in the memory, the state value acquired by the second terminal device; and specifying, based on stored correspondence information, a characteristic item of a voice that induces a change in the state value, the correspondence information associating the change in the state value from before to after a respective transmission timing of a voice from among the multiple voices transmitted to the target person in action with multiple characteristic items representing characteristics of each of the multiple voices, and the multiple characteristic items being specified based on voice data of each of the multiple voices, wherein the specifying comprises specifying, based on the correspondence information, (i) at least one characteristic item that induces the change in the state value, from among the multiple characteristic items, and (ii) a trend of the at least one characteristic item.

* * * * *